8/5/86 OR 4,603,910

United States Patent [19]

Lanéus

[11] Patent Number: 4,603,910

[45] Date of Patent: Aug. 5, 1986

[54] METHOD OF BLASTING ROCK CAVERNS WITH LARGE CROSS-SECTIONAL AREA

[75] Inventor: Per Lanéus, Vallingby, Sweden

[73] Assignee: JCC Construction Company AB, Stockholm, Sweden

[21] Appl. No.: 591,683

[22] Filed: Mar. 21, 1984

[30] Foreign Application Priority Data

Mar. 23, 1983 [SE] Sweden ..... 8301601

[51] Int. Cl.[4] ..... E21D 13/02

[52] U.S. Cl. ..... 299/13; 405/57

[58] Field of Search ..... 299/13, 2; 166/259, 166/299; 175/61; 405/57, 55, 53

[56] References Cited

U.S. PATENT DOCUMENTS

| | | | |
|---|---|---|---|
| 3,509,726 | 5/1970 | White | 405/259 |
| 3,897,107 | 7/1975 | Haglund | 299/13 |
| 3,917,348 | 11/1975 | Janssen | 299/2 X |
| 4,346,935 | 8/1982 | Huijnen | 299/2 |
| 4,378,949 | 4/1983 | Miller | 299/13 X |

FOREIGN PATENT DOCUMENTS

| | | | |
|---|---|---|---|
| 752003 | 7/1980 | U.S.S.R. | 299/13 |
| 752004 | 7/1980 | U.S.S.R. | 299/13 |
| 798303 | 1/1981 | U.S.S.R. | 299/13 |

*Primary Examiner*—Stephen J. Novosad
*Attorney, Agent, or Firm*—Curtis Ailes

[57] ABSTRACT

The method is especially useful for producing rock caverns for the storage of liquids such as water and oil. The method includes intersection blasting in accordance with the sublevel stopping method for at least one drift near the bottom of the intended rock cavern to produce at least one upwardly widening part section of the cavern. The cavern is then formed to its final cross-section by excavating rock above the part section through successive drilling and blasting of rock layers. The last-mentioned drilling is fan-shaped downwardly directed drilling to obtain an essentially lentiform cross-section of the cavern above the part section.

6 Claims, 4 Drawing Figures

METHOD OF BLASTING ROCK CAVERNS WITH LARGE CROSS-SECTIONAL AREA

Figure 2:
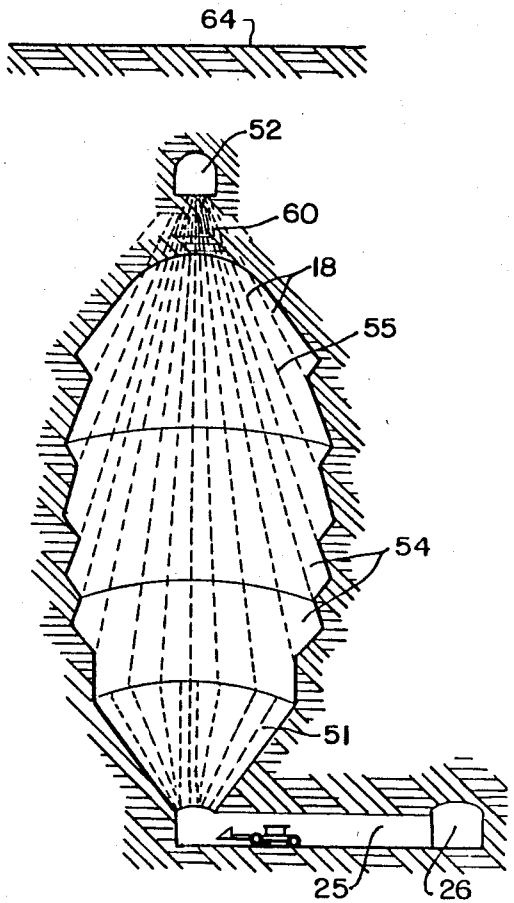

The present invention relates to a method of blasting essentially elongate rock caverns with a large cross-sectional area, preferably for the storage of liquids such as water and oil, comprising carrying through intersection blasting in accordance with the sub-level stoping method from at least one drift near the bottom of the intended rock cavern, to produce at least one upwardly widening part section of said cavern, and forming said cavern to its final cross-section by excavating rock above this part section through successive drilling and blasting of rock layers.

It is common practice to excavate rock caverns with large cross-sectional areas in sections by initially blasting a top heading, the roof and walls of which are reinforced to the required degree by means of rock bolts and shotcrete, after which the floor is lowered to the desired level by means of bench blasting and subsequent strengthening of the walls. Normally, large caverns excavated in this way have a width of approximately 20 m and a height of about 30 m.

A method has also been proposed for creating a boulder-filled cavern, for which intersection blasting is carried out in accordance with the sub-level caving method from a drift in connection with the bottom of the intended cavern. In this way an upwardly widening part section of the cavern is obtained. The cavern is formed to its final cross-section from three parallel top headings by means of vertical, downwardly directed successive drilling and blasting of rock layers. This results in the creation of a boulder-filled cavern with vertical side walls, the mutual distance of which corresponds to the greatest width of the part section referred to above.

It is generally the case in connection with the blasting of rock caverns that, in addition to the permanent reinforcements needed for the cavern's stability, the roof and walls must, at least during the course of the construction period, be strengthened to such an extent that personnel and machines are not injured or damaged, respectively, by falling stones. In a chamber intended for the storage of crude oils, a considerable proportion of the rock reinforcement measures no longer serve any function after the first filling of oil has occurred since it is subsequently impossible for personnel to gain access to the cavern. In existing caverns of this type, there are continual rock falls from the roof and walls, which can be accepted outside the area set aside for installed equipment as long as they do not occur to such an extent that the stability of the cavern itself is jeopardized. Many rock caverns constructed to date for the storage of liquids have, in view of their final purpose, therefore been unnecessarily extravagant with regard to reinforcement over and above that required for the cavern as an entity.

Examples of so-called "constructive permanent bolting" are to be found in Fort F/Bk Publication No. 21. According to these, constructive bolting has been used in the case of extremely thin rock overburden over tunnels by inserting permanent strengthening bolts in the rock roof of the finished tunnel from a reduced tunnel section with the aid of blind bolts made of wood. These blind bolts are later blasted away during the subsequent blasting to full section. Span widths of 8–10 m have been achieved.

Within the mining industry large voids are created under the ground in connection with ore extraction to which no-one has access, for example in conjunction with sub-level stoping. Examples of this technique are described in Swedish Pat. No. 7711548-3. When converted to blasted rock the volume of the rock increases, "swells", by approximately 65%.

It is also known earlier through the Swedish Pat. No. 7603944-5 (corresponding to Great Britain Pat. No. 1,574,453) to stabilize a rock cavern intended for the storage of liquids by completely filling the cavern with the blasted rock. One disadvantage of the complete filling of the chamber with rock is the lack of an open channel for even horizontal distribution of the heat-bearing liquid at the top and bottom of the cavern. This distribution is desirable for an effective utilization of the entire volume of a large heat storage facility with a limited number of intakes and outlets for the liquid.

One object of the present invention is to provide a method for blasting a rock cavern with a large area in an economically viable and safe manner, wherein the cavern should be given an optimal shape at the lowest possible costs and the cavern in addition should be given a form of reinforcement that is optimally adapted to each individual stage of the work and to the final entity and use of the cavern.

According to the invention said drilling, as defined by way of introduction above, comprises fan-shaped downwardly directed drilling to obtain an essentially lentiform cross-section of said cavern, the side walls of which at least partially lie outside the greatest cross-sectional width of said part section.

Figure 1:
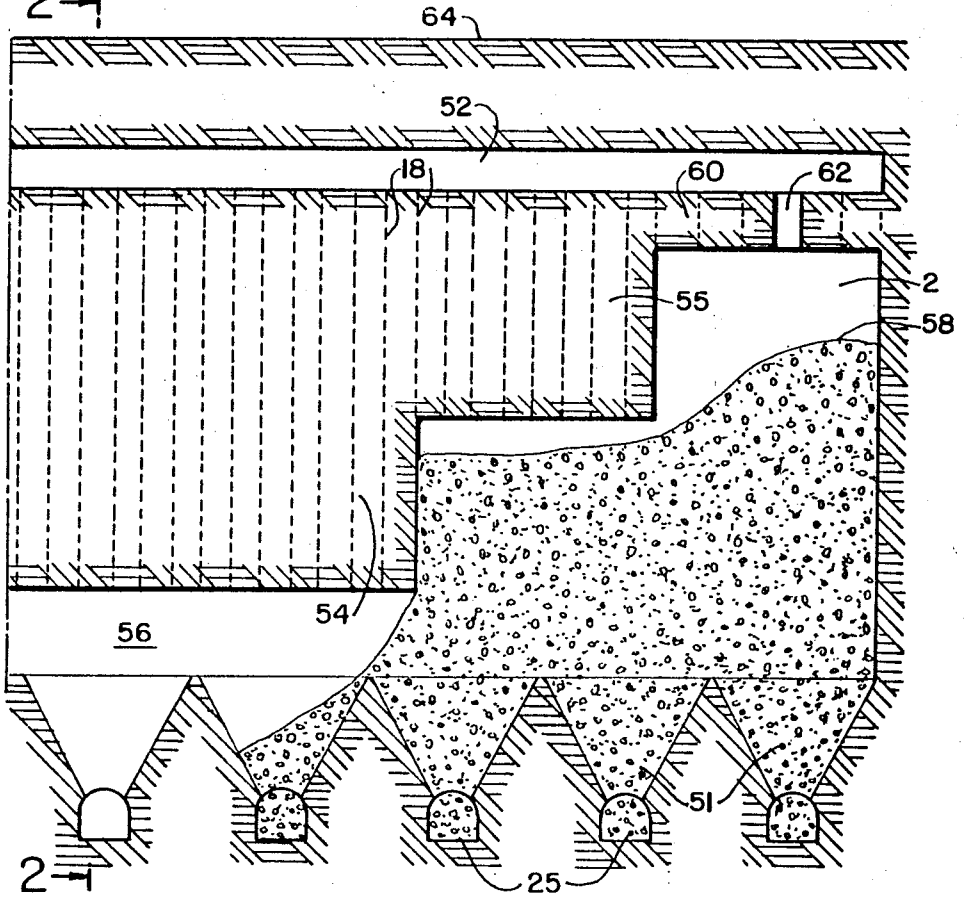

The invention shall now be described more in detail below with reference to the attached drawings, wherein FIG. 1 in longitudinal section and FIG. 2 in cross section along the plane II—II in FIG. 1, illustrate a first embodiment and FIGS. 3 and 4 in similar views as FIGS. 1 and 2 illustrate a further embodiment.

In the different embodiments, similar or equivalent details on the drawings partly have the same reference numerals. To the extent that certain aspects of the method described are omitted or not described in greater detail, it is understood that such aspects are well known to a person skilled within the art.

In FIGS. 1–4, a rock cavern in the process of being excavated has been designated 2. Excavation has commenced from a reaming section (not shown) at one end of the planned cavern.

In the method according to FIGS. 1 and 2, an open rock cavern 2 is executed with an oval or lens-shaped cross-section, intended for the storage of liquid. From side drifts 25 connected to a transport drift 26, intersection blasting is carried out at 51 to form a funnel-shaped lower space. Removal of blasted rock is then effected via the transport drift 26. From a dirlling drift 52 located above the planned cavern, and symmetrically with respect thereto, drill holes 18 are drilled in a fan-shaped pattern for blasting of horizontal rock layers 54, once sufficiently large voids 56 for permitting swelling of each slab have been created by means of transporting rock from the cavern. Observations and determination of the upper surface of rock material 58 can be carried out at each stage through drill holes from the drift 52. Before each blasting operation a rock slab 60 located between the drift 52 and the roof of the planned cavern is reinforced with the aid of rock bolts (not shown) inserted in certain of the drill holes. As a result of the fact that one rock layer 60 nearest the drilling drift is thus retained, the drift can be utilized as a pipe and cable drift for the cavern. Shafts 62 for gauging and observation can be driven through this rock layer.

If the cavern according to the embodiment illustrated in FIGS. 1 and 2 is intended to be located near the ground surface 64, all work in connection with drilling and blasting of the rock layer can be carried out from the ground surface according to a modification.

Figure 4:
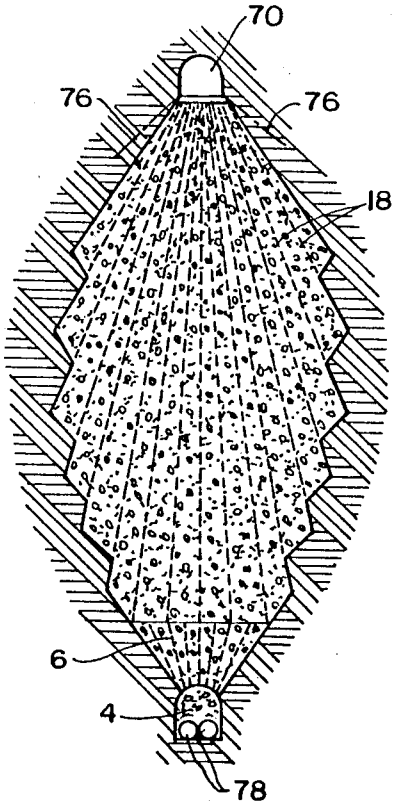
Figure 3:
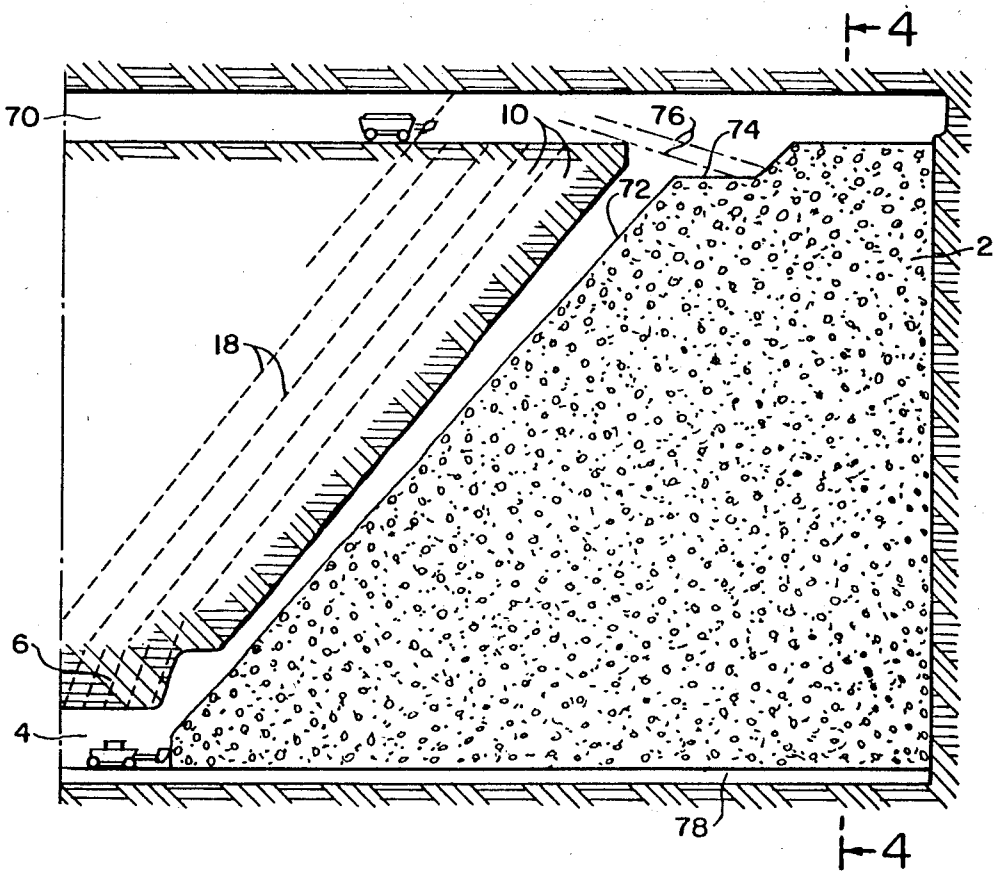

By the method according to FIGS. 3 and 4, a boulder-filled rock cavern 2 is created with a lens-shaped cross-section for the storage of liquid-borne heat. Intersection blasting takes place at 6 from a bottom drift 4 to provide a lower space widening upwardly. Concurrently with the intersection blasting, blasting takes place through sublevel stoping from an upper drilling drift 70 for blasting the rock layers 10 located in planes somewhat steeper than the slope of the rock material 72 against the bottom drift 4. The layers 10 are separated by drill planes including drill holes 18 in a fan-shaped pattern executed from drilling drift 70. In order to further raise the upper surface of the rock material, designated 74 in FIG. 3, to about the same level as the floor of the drilling drift 70, blasting is carried out in backwardly sloping holes 76.

Pipes 78 are laid down in the bottom drift 4 for the distribution of cold water in the cavern. The drilling drift 70 serves as an open channel for the distribution of hot water during use of the cavern.

In the embodiments described, the room can have a width of 30–60 m and a height of 60–120 m. The direction and cross-section of the room should preferably be determined with the aid of data from a geological survey of the type of rock in question and a strength analysis, for example in accordance with the finite element method.

The cavern constructed with the methods according to the invention are primarily intended for the storage of liquids, such as water and oil, but they could also serve as air or water storages for pump power plants, machine rooms or as boulder-filled safety tunnels at nuclear power plants.

The invention is, of course, by no means limited to the embodiments described above and shown on the drawings, but can be modified within the scope of the claims.

Thus, a discharge drift can e.g. also be driven beneath the bottom drift.

The cavern floor can over its entire length be laid to a slope steeper than the stone's natural slope angle for discharge of the blasted rock through only one funnel-shaped opening.

By the invention a method is provided which by avoidance of the "vertical wall concept" commonly adopted to date by specialists in this field, facilitates the construction of larger rock caverns than has previously been considered possible. This is achieved partly by the utilization of non-conventional, cross-sectcional cavern configurations. Furthermore, a type of reinforcement is proposed for the cavern which is adapted in a natural way to the actual driving work. By providing certain of the drill holes with reinforcement means prior to blasting, the cavern attains such a degree of stability that the subsequent work of strengthening the roof and walls can be carried out inside the cavern from the surface of the blasted rock following sublevel stoping, the level of the blasted rock being gradually lowered by discharge and removal from within the cavern itself or from side drifts at the base of the cavern, or that the cavern can be used as a cistern for the storage of liquids, without further reinforcement work, after partial or complete discharge of the blasted rock from the bottom of the cavern carried through continuously or following completion of cavern blasting.

Pumps and gauging and control equipment for the cistern can be housed in a completely rock-reinforced separate shaft in association with the cavern.

I claim:

1. A method of blasting essentially elongated rock caverns with a large cross-sectional area, preferably for the storage of liquids such as water and oil, comprising carrying through intersection blasting in accordance with the sublevel stoping method from at least one drift near the bottom of the intended rock cavern, to produce at least one upwardly widening part section of said cavern, and forming said cavern to its final cross-section by excavating rock above this part section through successive drilling and blasting of rock layers, said drilling comprising fan-shaped downwardly directed drilling to obtain an essentially lentiform cross-section of said cavern above said part section, the side walls of which at least partially lie outside the greatest cross-sectional width of said part section.

2. A method in accordance with claim 1, comprising driving a drilling drift in the length direction of the intended cavern and located essentially symmetrically with respect to the intended cavern on a level in or above the roof of the cavern, said downwardly directed drilling comprising drilling from said last-mentioned drilling drift.

3. A method according to claim 2, comprising forming a boulder filled room by sub-level caving including drilling said downwardly directed drill holes from said last-mentioned drilling drift extending in planes somewhat steeper than the slope of the stone mass to said bottom drift.

4. A method in accordance with claim 3, comprising drilling backwardly sloping drill holes having in section preferably a steeper slope than the natural angle of the stones, and blasting to raise the upper surface of the blasted rock to the level of the floor of said drilling drift.

5. A method in accordance with claim 1, comprising drilling at least certain drill holes to extend with parts thereof outside the contours of the intended cavern and providing reinforcement means in said parts beyond said contours prior to blasting.

6. A method in accordance with claim 1, in which said forming comprises blasting horizontal rock layers, and discharging the blasted rock under the uppermost horizontal rock layer in the cavern so that the void beneath said uppermost layer is approximately equivalent to the expected rock swelling in the course of blasting said layer, whereby a cavern is obtained that is boulder filled to a level near the ground surface or the floor of a drilling drift.

* * * * *

UNITED STATES PATENT AND TRADEMARK OFFICE

CERTIFICATE OF CORRECTION

PATENT NO. : 4,603,910

DATED : Aug. 5, 1986

INVENTOR(S) : Per Laneus

It is certified that error appears in the above-identified patent and that said Letters Patent are hereby corrected as shown below:

| | | |
|---|---|---|
| Abstract, | line 4, | "for" should read --from--. |
| Column 2, | line 56, | "dirlling" should read --drilling--. |
| Column 3, | line 37, | "cavern" should read --caverns--. |

Signed and Sealed this

Fourteenth Day of October, 1986

[SEAL]

*Attest:*

DONALD J. QUIGG

*Attesting Officer*

*Commissioner of Patents and Trademarks*